US005391242A

United States Patent [19]

Sakal et al.

[11] Patent Number: 5,391,242

[45] Date of Patent: Feb. 21, 1995

[54] HIGH-STRENGTH AND HIGH-CONDUCTIVITY COPPER ALLOY SHEET

[75] Inventors: Yoshikazu Sakal; Kiyoshi Inoue; Hiroshi Maeda, all of Tsukuba, Japan

[73] Assignee: National Research Institute for Metals, Tokyo, Japan

[21] Appl. No.: 128,762

[22] Filed: Sep. 17, 1993

[30] Foreign Application Priority Data

Sep. 17, 1992 [JP] Japan ..... 4-272548

[51] Int. Cl.[6] ..... C22C 9/00

[52] U.S. Cl. ..... 148/432; 148/684; 148/554; 420/497

[58] Field of Search ..... 148/432, 554, 684, 553, 148/680; 420/497; C22C 9/00

[56] References Cited

FOREIGN PATENT DOCUMENTS 58-128292 7/1983 Japan .

*Primary Examiner*—Richard O. Dean
*Assistant Examiner*—Sean Vincent
*Attorney, Agent, or Firm*—Wenderoth, Lind & Ponack

[57] ABSTRACT

A high-strength and high-conductivity copper alloy sheet is provided, which consists of a composition of from 6 to 24 wt. % Ag, and Cu and impurities as the balance, and has a sheet structure in which Cu solid solution and Ag solid solution are streched into a fiber shape.

7 Claims, 5 Drawing Sheets

HIGH-STRENGTH AND HIGH-CONDUCTIVITY COPPER ALLOY SHEET

FIELD OF THE INVENTION

The present invention relates to a high-strength and high-conductivity copper alloy sheet. More particularly, the present invention relates to a high-strength and high-conductivity copper alloy sheet useful for an IC lead frame and a magnet conductor.

DESCRIPTION OF THE RELATED ART

A high-strength and high-conductivity sheet has been earned to be developed, particularly in the electronic industry, as a material for a lead frame of IC and for a conductor of a high field magnet. The development of such a conductor is in the worldwide competition.

For example, with respect to a lead frame, at present, there is no material which satisfies the property of Class $III_{HH}$ (an electrical conductivity of at least 80% IACS and a tensile strength of at least 650 MPa) and Class $III_H$ (a conductivity of 80 to 50% IACS and a tensile strength of at least 650 MPa). Because of this, in the IC technology in which a higher integration and a more advanced performance are making progress, there is a strong demand for the development of a material for a lead frame having these Class $III_H$ and Class $III_{HH}$ properties as well as a lower cost and a higher reliability.

According to the development of a Bitter-type high field magnet in which a sheet material is used for a conductor, a conductor is required a high strength sufficient to withstand a high-generated electromagnetic force and a high electrical conductivity preventing heat generation. A Cu—Be alloy, a Cu—Cr alloy and a Cu—$Al_2O_3$ alloy have been known as such a conductor material for the Bitter magnet. However, the Cu—Be alloy is low in conductivity, the Cu—Cr alloy and the Cu—$Al_2O_3$ alloy are low in strength, and either alloy is poor in a balance between strength and conductivity.

A Cu—Be alloy developed in the United States has a strength of 800 MPa and a conductivity of 63% IACS, which has been estimated to be a conductor material having a good balance between strength and conductivity. However, a new conductor material having further higher strength and conductivity over those characteristic values are necessary in the development of a magnet producing a higher magnetic field.

In view of these circumstances, the present inventor has developed a Cu—Ag alloy as a new high-strength and high-conductivity alloy material, and has been studying for a practical application thereof up to now.

However, the Cu—Ag alloy has a problem in that its strength may be insufficient when working into the form of a sheet, and this is an important problem to be solved for the practical application.

The present invention has an object to provide a Cu—Ag alloy sheet having excellent properties which have been conventionally unavailable, as a high-conductivity sheet without impairing a high-strength property.

Other objects, features and advantages of the present invention will be further clarified from the following detailed description and drawings.

DETAILED DESCRIPTION OF THE INVENTION

Figure 1:
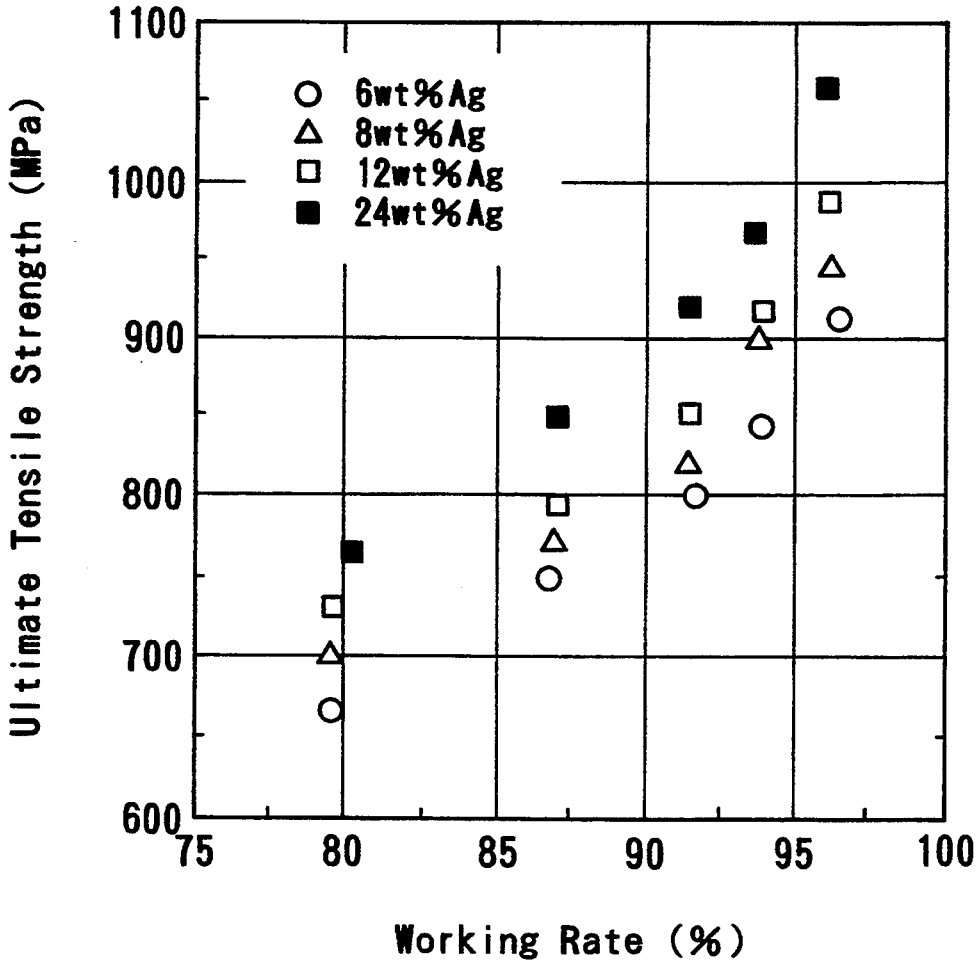
FIG. 1 is a correlation diagram illustrating ultimate tensile strength relative to working rate of Cu- from 6 to 24 wt. % Ag alloy sheets.

The present invention provides a high-strength and high-conductivity copper alloy sheet, comprising a composition of from 6 to 24 wt. % Ag, and Cu and impurities as the balance, having a sheet structure in which Cu solid solution and Ag solid solution are stretched into a fiber shape.

In the Cu—Ag alloy sheet of the present invention, a structure consisting of two phases of Cu solid solution and Ag solid solution is resulted from adding from 6 to 24 wt. % Ag to Cu. According to the rolling of the material, the two phases are extended into a filament shape, thus bringing about a considerable increase in strength of the Cu—Ag alloy. If the Cu solution and the Ag solid solution contain supersaturated solutes of Ag and Cu, respectively, the supersaturated solutes of Ag and Cu will be precipitated by heat treatment, and strength and conductivity of the Cu—Ag alloy will be much higher.

However, it has generally been believed that hardening through precipitation of Cu—Ag alloy is not expected by heat treatment. In fact, the Cu—Ag alloy having the above-mentioned composition does not remarkably change in hardness, even though heat treatment is performed. To the contrary, a new finding was obtained, in which a new combination of working and heat treatment promotes the precipitation and leads to a remarkable increase in hardness of Cu—Ag alloy. A novel Cu—Ag alloy sheet having a high strength as well as a high conductivity was made available. The combination of working and heat treatment referred to here includes appropriate repetition of more than once of the respective working and heat treatment, and series of repetition in which a plurality of working and heat treatment are subsequently performed, for example, working—heat treatment—working—heat treatment.

Strength and conductivity properties of the Cu—Ag alloy varies with the extent of working, temperature and time of heat treatment, and frequency of working and heat treatment. The heat treatment is, in general, carried out at a temperature range of about 300° to 600° C., more preferably, about 300° to 550° C. The heat treatment time is preferably about 0.5 to 40 hours. Particularly, application of a few times of heat treatment as an intermediate treatment during the cold-working step is effective to improvement of strength and conductivity. Cold-working is appropriately carried out by such means as rolling.

The Cu—Ag alloy of the present invention is formed into a textural composite sheet through rolling. However, with regard to such a textural composite sheet as of several metals and alloys, in general, strength in the rectangular direction to the rolling direction is far lower than that in the rolling direction, and hence it has been believed to be difficult to use the Cu—Ag alloy in the form of a sheet. Contrary to the conventional common sense, the Cu—Ag alloy sheet of the present invention has smaller anisotropy in strength and conductivity to the rolling direction, and has more excellent strength and conductivity than the conventional materials.

Furthermore, addition of from 6 to 24 wt. % Ag to Cu permits an initial crystal (Cu solid solution) and an eutectic (a phase consisting of Cu solid solution and Ag solid solution) to uniformly crystallize, and cold-working, such as rolling, of the product stretches the structure into a textural shape, thus giving a high strength. With the amount of added Ag of under 6 wt. %, the desired properties are not obtained. Addition of Ag in an amount of over 24 wt. % gives, on the other hand, no remarkable effect in the improvement of strength of the Cu—Ag alloy, and it not economical when considering general uses because of this.

As described in the above, a Cu—Ag alloy sheet of the present invention is easily manufactured through dissolution and rolling, and a high strength and a high conductivity are achieved by a simple operational procedure of heat treatment applied in the course of working. Since excellent properties are available with a very low Ag concentration of only 6 wt. %, for example, the Cu—Ag alloy sheet of the present invention is also advantageous to economy.

EXAMPLE

Ag in an amount of from 6 to 24 wt. % was added to Cu, and the mixture was melted in vacuum or in an inert gas atmosphere. The melt sample was cast, and then, the cast strand was cold-rolled. After applying heat treatment at 450° C. for two hours at a working rate of 10%, thus heat-treated sheet was further subjected to cold-rolling. Subsequently, applying an intermediate heat treatment at 450° C. for one hour at a working rate of 35% and at 400° C. for one hour at a working rate of 60%, the final cold-rolling was applied to 96%.

As shown in FIG. 1, the ultimate tensile strength achieved at a working rate of 80% was 650 MPa with 6 wt. % Ag, 700 MPa with 8 wt. % Ag, 725 MPa with 12 wt. % Ag, and 760 MPa with 24 wt. % Ag. At a working rate of 96%, ultimate tensile strengths were 912 MPa, 947 MPa, 989 MPa and 1050 MPa, respectively. Conductivity had a uniform relationship with strength in the Cu—Ag alloy sheets of any of the compositions. The working rate was expressed by a formula: $((to-t)/to)\times 100$ (where, to: thickness of cast strand, and t: thickness of worked sheet)

Figure 2:
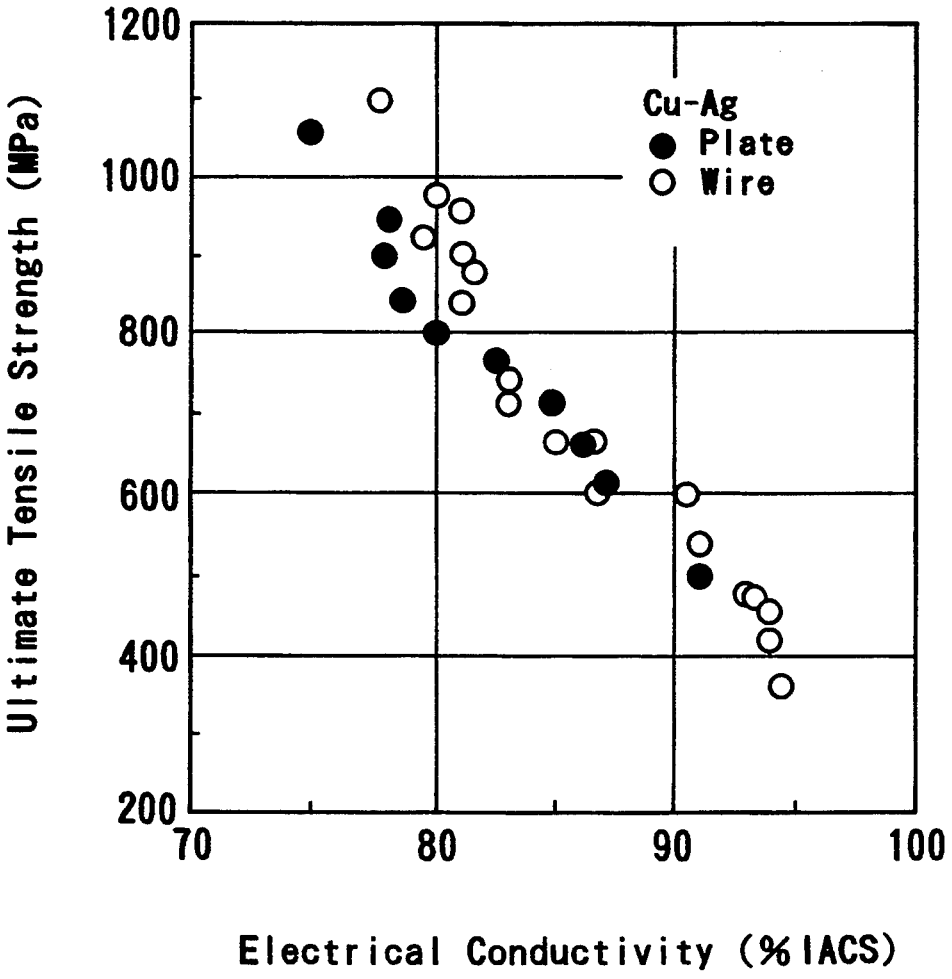
FIG. 2 is a correlation diagram illustrating a relationship between conductivity and ultimate tensile strength of Cu—Ag alloy.

As shown in FIG. 2, the conductivity of 90% IACS was obtained with the ultimate tensile strength of 520 MPa. 80% IACS was obtained with 800 MPa, and 75% IACS with 1050 MPa.

Figure 3:
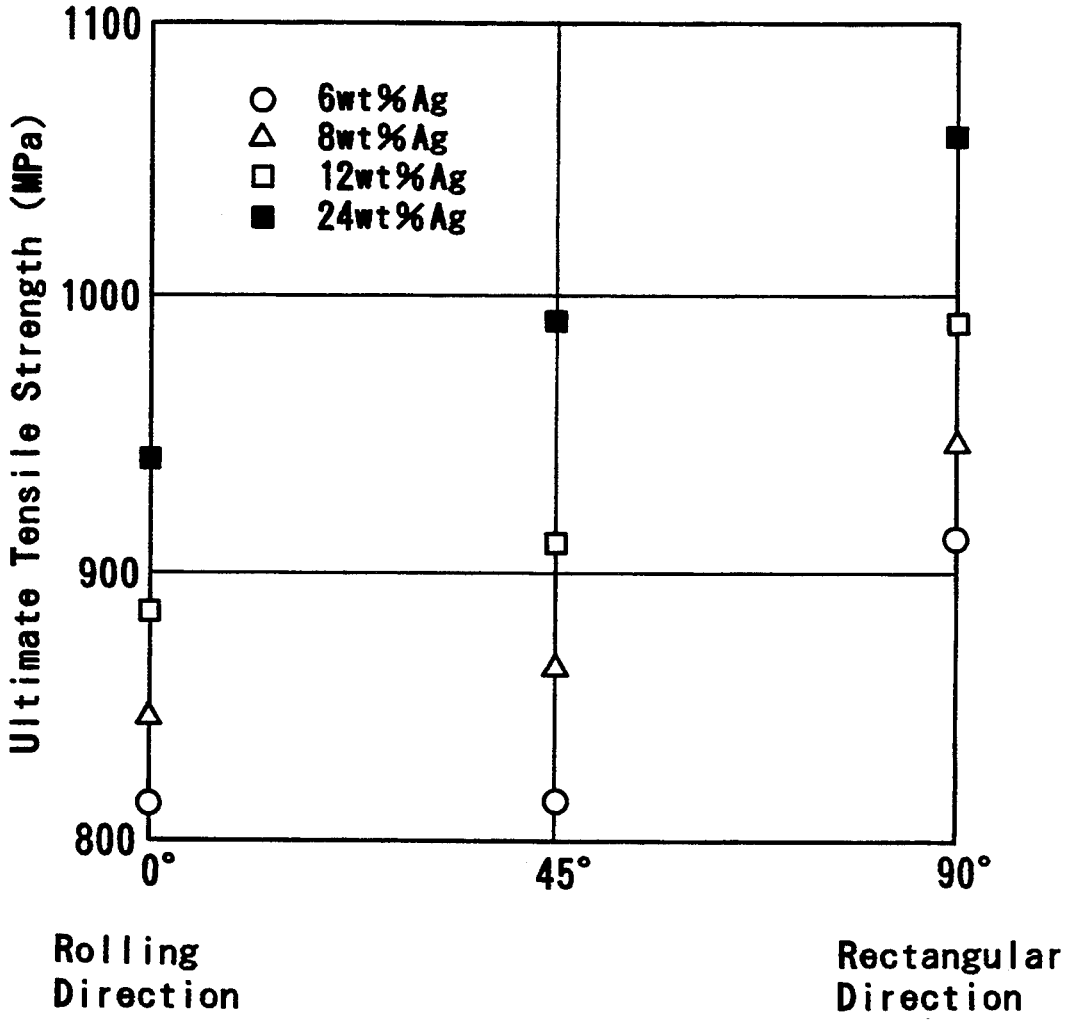
FIG. 3 is a correlation diagram illustrating strength anisotropy of Cu—6–24 wt. % Ag alloy sheets at a working rate of 95%.

As illustrated in FIG. 3, the Cu—Ag alloy sheet showed an unexpectedly excellent properties in that strength in the rectangular direction to the rolling direction was higher than that in the rolling direction. The difference in strengths between the rectangular direction and rolling one was about 100 MPa at the working rate of 95%.

Figure 4:
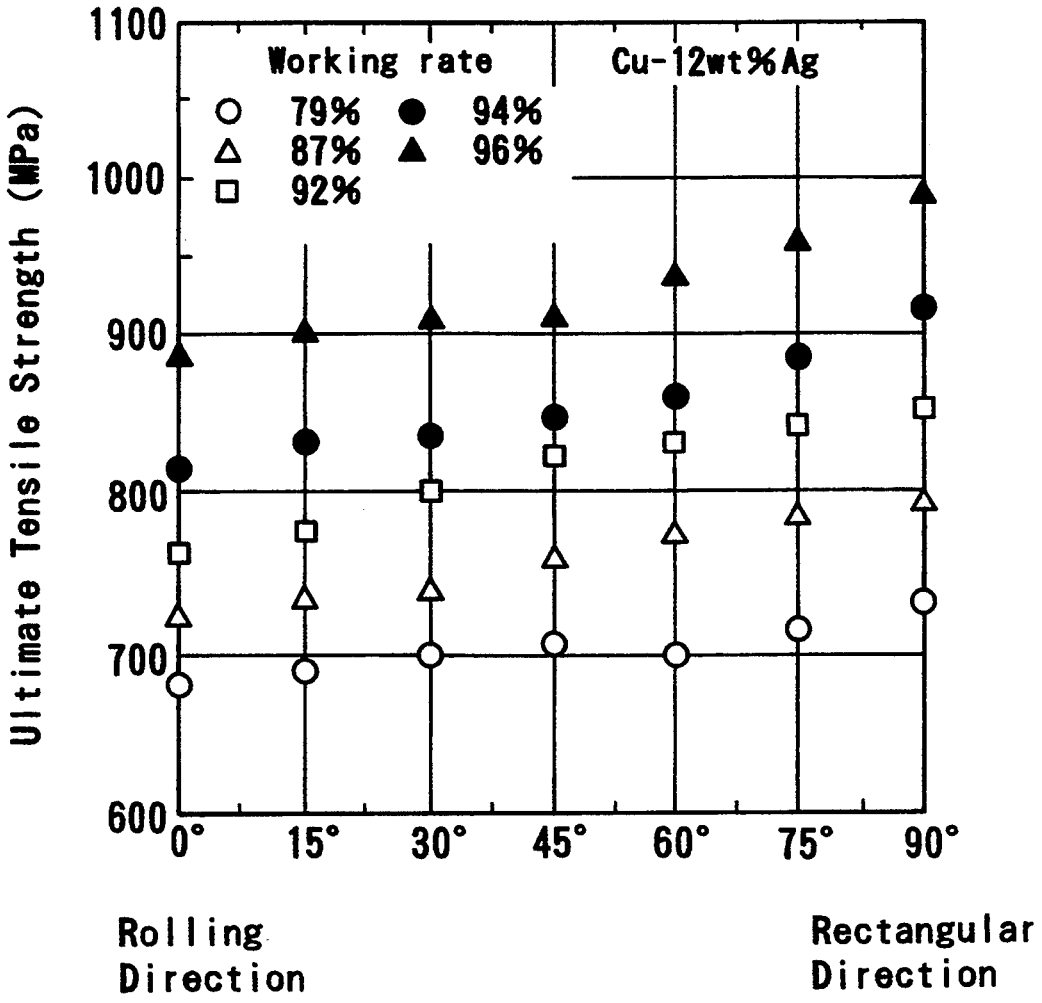
FIG. 4 is a correlation diagram illustrating strength anisotropy of a Cu—12 wt. % Ag alloy sheet in terms of working rate.

As shown in FIG. 4, furthermore, the difference in strengths between two directions became smaller in lower-worked samples. No marked difference was observed as to anisotropy in conductivity.

Figure 5:
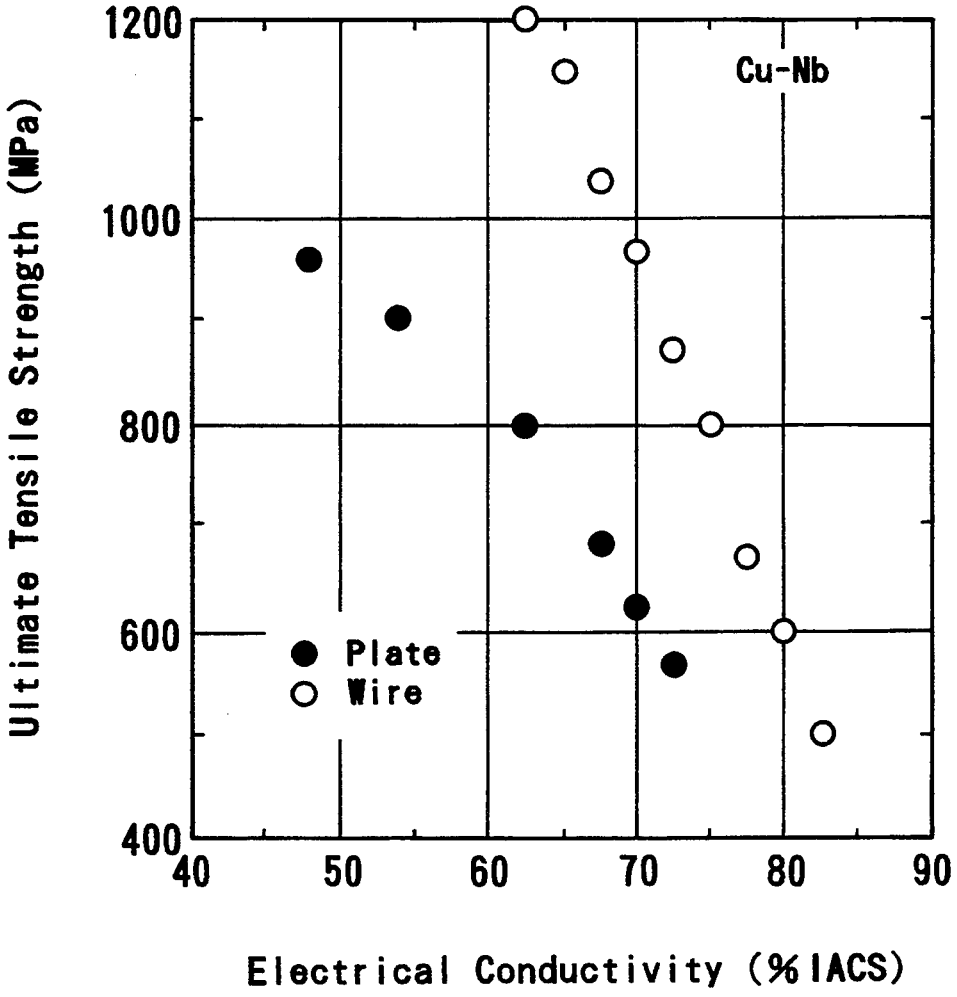
FIG. 5 is a correlation diagram illustrating a relationship between conductivity and ultimate tensile strength of a Cu—Nb alloy sheet and a wire as a referential example.

Compared with the relationship between strength and conductivity of a Cu—Nb alloy sheet and a wire shown in FIG. 5, the decrease in conductivity is larger in the sheet in the case of the Cu—Nb alloy. The Cu—Nb alloy is known as a texture-reinforced composite material having a worked structure similar to that of the Cu—Ag alloy. In the Cu—Ag alloy sheet, on the other hand, the relationship between conductivity and strength is similar to that in a wire, and is quite different from that derived from the traditional technological common sense.

The above description clearly demonstrates the practical significance of the Cu—Ag alloy sheet of the present invention.

It is needless to mention that the present invention is not limited to the above example. It is of course possible to make diverse and various embodiments for the details.

What is claimed is:

1. A copper alloy sheet having high-strength and high-conductivity properties, consisting essentially of from 6 to 24 weight percent Ag, and with the balance being Cu and a small amount of inevitable impurities, said copper alloy sheet having a sheet-shaped structure where both Cu and Ag solid solutions are stretched into fiber shapes.

2. A copper alloy sheet as claimed in claim 1, wherein said sheet-shaped structure of said copper alloy sheet is formed through a combination of rolling steps and heat treatment steps after said rolling steps, whereby said Cu and Ag solid solutions are stretched into fiber shapes.

3. A copper alloy sheet as claimed in claim 2, wherein said copper alloy sheet is subjected to said rolling and heat treatment steps, alternately.

4. A copper sheet alloy as claimed in claim 3 whereby said copper alloy sheet is subjected to a series of rolling and heat treatment steps, alternately applied.

5. A copper alloy sheet as claimed in claim 2, 3 or 4, wherein said copper alloy sheet is heat-treated at a temperature range of from 300° to 600° C.

6. A copper alloy sheet as claimed in claims 2, 3 or 4, wherein said copper alloy sheet is heat-treated at a temperature range of from 300° to 550° C. for 0.5 to 40 hours.

7. A copper alloy sheet as claimed in claim 2, wherein said rolling step is a cold-rolling step.

* * * * *